United States Patent [19]

Eiselstein et al.

[11] 4,153,455

[45] May 8, 1979

[54] HIGH TEMPERATURE NICKEL-BASE ALLOYS

[75] Inventors: Herbert L. Eiselstein, Huntington; Allen C. Lingenfelter, Ona, both of W. Va.

[73] Assignee: Huntington Alloys, Inc., Huntington, W. Va.

[21] Appl. No.: 798,651

[22] Filed: May 19, 1977

[51] Int. Cl.[2] ..... C22C 19/05

[52] U.S. Cl. ..... 75/171; 148/32; 148/32.5; 176/88

[58] Field of Search ..... 75/171, 170; 148/32, 148/32.5; 176/88

[56] References Cited

U.S. PATENT DOCUMENTS 3,865,581 2/1975 Sekino et al. ..... 75/171

*Primary Examiner*—R. Dean

*Attorney, Agent, or Firm*—Raymond J. Kenny; Ewan C. MacQueen

[57] ABSTRACT

A nickel-base alloy intended for diverse application, including components for high temperature, gas cooled reactors (HTGR), the alloy containing, in addition to nickel, chromium, tungsten, titanium and carbon, the presence of aluminum and cobalt being controlled for HTGR use.

6 Claims, No Drawings

HIGH TEMPERATURE NICKEL-BASE ALLOYS

The present invention is directed to nickel alloys, particularly nickel-base alloys for High Temperature Gas Cooled Reactor applications.

As the metallurgist is aware, given their high temperature capabilities, together with an inherent ability to withstand the ravages occasioned by aggressive corrosive media, nickel-base materials have found extensive use in a host of diverse environments. Any by reason of such characteristics such alloys would be expected to be leading candidates for nuclear power systems in general. However, in respect of at least one of the more recently advanced concepts in nuclear power generation, to wit, the High Temperature Gas Cooled Reactor (HTGR), it would appear that available commercial nickel-base materials will be found wanting in one or more respects. We so found in respect of an alloy which we deemed would be particularly attractive for HTGR components by virtue of its known mechanical and physical properties.

By way of explanation, in terms of one aspect of the problem, it is considered that optimum economies are likely to be best realized using high core temperatures, circa 1000° C. Being inert and possessing excellent thermal conductivity, helium is expected to be used as the heat transfer coolant. High temperature helium would be used for both electric power generation and as process heat in such applications as chemical processing. But we have found that at high temperatures the very small percentages of CO, $CO_2$ and $O_2$ in helium can give rise to certain oxidation problems, largely one of an internal oxidation phenomenon. As a consequence, premature degradation of alloy components could ensue.

Oxidation considerations aside, an acceptable HTGR alloy must afford a combination of distinct properties. For example, since long service life (upwards of 20 years) is a virtually indispensible desideratum the alloy manifest high resistance to creep at elevated temperature, say, not more than about 1% over a 100,000 hour time span. And at such temperatures, high strength and metallurgical stability are required over long periods. Equally, if not more important, since thin wall heat exchanger tubing is a major HTGR component, any candidate alloy must afford good malleability, particularly forgeability, and this is difficult to achieve given the high strength characteristics required. Furthermore, good weldability is another important consideration in the light of various HTGR components required.

In any case, we have discovered a novel alloy composition capable of delivering the combination of metallurgical characteristics above discussed. While the subject alloy is deemed particularly useful in the production of HTGR fabricated components, it will be understood that the alloy can be used for other applications such as pyrolysis furnaces, superheater tubing, furnace parts, steam generator tubing, condenser tubing, heat treatment baskets, recuperators, aerospace equipment, turbines and rockets, waste disposal, etc.

Generally speaking, the present invention contemplates the provision of nickel alloys containing about 22 to less than 28% chromium, from 3 to 9% tungsten, titanium present in a small effective amount to enhance malleability, notably forgeability, and up to about 1%, up to about 0.1% carbon, iron present in an amount up to 25%, with the balance being essentially nickel, the nickel being at least about 50% but preferably not exceeding about 65%.

In the production of the alloys contemplated herein, care should be taken to avoid the presence of cobalt for nuclear use by reason of the inherent danger associated with radioactivity; otherwise, the alloys can contain up to 5% cobalt, e.g., 0.1 to 1%.

While most nickel-base, high temperature, superalloys contain aluminum for purposes of strength, oxidation resistance, etc., care again must be exercised for HTGR applications with regard to aluminum content. We have found that aluminum causes or contributes to the above-mentioned oxidation problem, not so much in the sense of conventional oxidation resistance, but as an internal and intergranular oxidation degradation. It is believed that this phenomena involves, at least in part, an interaction of aluminum with one or more impurities, including CO, $CO_2$, $O_2$ and methane, found in the helium reactor coolant. Accordingly, aluminum should be held to a minimum, say, less than 0.15% and preferably less than about 0.05% for nuclear components. (It should be mentioned that furnace linings can be a source of aluminum.) It has also been found that aluminum, at least percentages on the order of about 1%, detract from high temperature creep properties. It is deemed beneficial for other high temperature applications that aluminum not exceed 0.6%.

In carrying the invention into practice, it is preferred that chromium be present in an amount of 23.5% in the interests of improved corrosion resistance. An upper level of 26% is deemed advantageous inasmuch as we have found that the upper percentage range offers higher rupture strengths coupled with corrosion resistance, but without a deleterious sacrifice in creep resistance. The higher chromium levels, circa 28%, tend to render the alloys less stable. Chromium from 23 to 26% is considered about optimum, given the combination of properties required for HTGR use.

Tungsten has been found, inter alia, to contribute to resistance to creep. In this connection, it would appear that tungsten in the range of 5 to 7%, particularly about 6%, offers the optimum in this regard. High tungsten levels should be avoided. Results using 15% tungsten, for example, reflect a loss in creep resistance due, it is believed, to the occurrence of a second phase (thought to be tungsten rich). As the tungsten is increased, stress-rupture strength is improved, although some loss of ductility might be experienced.

Molybdenum should not be considered a substitute for tungsten. Molybdenum detracts from high temperature creep resistance for HTGR use as evident from tests at 800° C. and 1000° C.; however, up to 1%, possibly 2%, molybdenum can usually be tolerated.

Titanium plays a most important role with regard to malleability, particularly forgeability, a critical factor for producing wrought products, e.g., tubing. Titanium-free alloys have manifested cracking upon forging. Similar behavior has been encountered with 0.1% titanium. It should be above 0.2%, a range of 0.25–0.5% being generally satisfactory. The upper titanium content need not exceed 1%. Titanium is also useful as a deoxidant. Zirconium and columbium though they can be present up to 0.05% and 1%, respectively, are not deemed the equivalents of titanium. Neither columbium nor zirconium offer the malleability characteristics of titanium.

As noted above, the nickel content preferably should not exceed about 65%. While this constituent may be found in percentages, say, up to 70%, such higher levels tend to result in lower creep resistance at 1000° C. And while the nickel level might be extended down to 40%, again the creep resistance at 1000° C. has been found to be inferior.

The presence of iron permits of the use of ferrochromium instead of more expensive pure chromium. A minimum iron content of 5%, or 8%, is considered beneficial.

Turning to other constituents, the carbon content should not exceed 0.1% though carbon does tend to add to stress-rupture strength. However, carbon brings about decarburization in service leading to a loss in creep resistance, particularly in respect of a helium environment. Therefore, it is preferred that carbon not exceed 0.06%. In terms of silicon and manganese, these elements can be present in amounts up to 1% and 2%, respectively. In this connection, silicon can adversely affect weldability and detract from creep resistance. Up to at least 0.01% boron can be incorporated in the subject alloys, it being preferred that 0.001% be present.

Magnesium and/or mischmetal can be incorporated in the alloys for deoxidation and other purposes. A retained magnesium level of up to 0.04%, e.g., 0.005 to 0.025%, is acceptable with a mischmetal or cerium content of up to 0.1% also being satisfactory. Calcium up to about 0.01% retained can also be used for deoxidation purposes.

The following description and data are given as representative of the instant invention.

A series of alloys (30 lb. heats) was prepared, in the following manner.

(i) nickel, metallic chrome, iron and tungsten pellets were charged in alternate layers in a furnace;

(ii) the charges were melted under vacuum, approximately 46–100 microns;

(iii) bath temperature was adjusted to 2900°–2950° F. and refined thereat for 15 minutes to ensure that the elemental tungsten pellets dissolved completely;

(iv) bath temperature adjusted to 2800°–2850° F. with the following additions usually being made (except where so indicated below) in the following order at approximately ½ atmosphere of argon.

| | Addition Element or Alloy | Actual Charge Per Cent | Typical Recovery |
|---|---|---|---|
| a) | Al | 0.07 | 0.07 – 0.10* |
| b) | Ti | 0.37 | 0.33 – 0.44 |
| c) | B as NiB | 0.003 | 0.003 – 0.44 |
| d) | Mg as NiMg | 0.05 | 0.002 – 0.024 |

*0.02–0.03 Al pickup attributed to $Al_2O_3$ furnace lining.

(v) heats held two (2) minutes after additions to allow for proper stirring and reaction times;

(vi) heats tapped under ½ atmosphere of argon in air;

(vii) heats were hot forged (if possible) into bar stock for test, 9/16" square bar being used for the creep rupture specimens and 3/4" × 2" × 6" flats being used as weldability samples.

TABLE I

| Alloy | Cr | W | Ni | Ti | Al | B | C | Mg | COMMENT | Fe | Other |
|---|---|---|---|---|---|---|---|---|---|---|---|
| A | 22 | 6 | 54 | .01 | .01 | 0.003 | .01 | | Broke on Forging | Bal. | |
| B | 22 | 3 | 54 | 0.05 | 0.05 | | | | ''''' | " | |
| C | 22 | 6 | 54 | 0.05 | 0.05 | | | | ''''' | " | |
| D | 22 | 9 | 54 | 0.05 | 0.05 | | | | ''''' | " | |
| E | 22 | 6 | 54 | 0.01 | 0.01 | 0.003 | .01 | 0.05 | ''''' | " | 0.015 Zr |
| 6 | 24 | 6 | 54 | 0.35 | 0.05 | 0.003 | .01 | 0.05 | Forged but did not improve | " | 1% Cb |
| 1 | 24 | 6 | 54 | 0.35 | 0.05 | 0.003 | 0.01 | 0.05 | Forged Well; No detrimental oxidation | Bal. | |
| 2 | 22 | 6 | 60 | 0.35 | 0.05 | 0.003 | 0.01 | 0.05 | ''''' | " | |
| 3 | 21.90 | 5.88 | 54.75 | 0.43 | 0.07 | 0.004 | 0.04 | 0.023 | ''''' | 17.27 | |
| 4 | 21.78 | 8.7 | 54.36 | 0.43 | 0.07 | 0.003 | 0.04 | 0.025 | ''''' | 14.44 | |
| 5 | 23.08 | 7.54 | 50.98 | 0.45 | 0.09 | 0.003 | 0.04 | | ''''' | Bal. | |
| G | 22 | 3 | 54 | 0.35 | 1 | 0.003 | 0.02 | 0.009 | Deleterious Internal Oxidation | Bal. | |
| H | 22 | 6 | 54 | 0.35 | 1 | 0.004 | <0.01 | 0.008 | ''''' | " | |
| I | 22 | 9 | 54 | 0.35 | 1 | | | | ''''' | " | |
| J | 22 | 6 | 54 | 0.05 | 2 | | | | ''''' | " | 9 Mo |

It will be observed that in Table I that alloys virtually free of or very low in titanium, Alloys A–E, broke on forging. Without good forgeability characteristics, the alloys would be quite unsuitable for nuclear reactor fabricated components, irrespective of how attractive other characteristics might be. The behavior of such alloys are in marked contrast with Alloys 1–6 (the presence of columbium in Alloy 6 did not further improve forgeability). It will also be noted that alloys (Alloys G–J) relatively high in aluminum (1%, 2%) manifested a propensity to undergo internal attack by way of an apparent oxidation phenomenon.

As above indicated, resistance to creep is of utmost importance. The data reported in Table II indicates the excellent response to creep exhibited by alloys in accordance herewith (Alloys 3, 4 and 6) vs. alloys beyond the invention (G, H and K). The presence of molybdenum or aluminum appeared to detract from creep resistance. Creep rates of 0.0000X% or 0.00000X%/hr. would indicate an ability to meet a 1% total creep requirement at 100,000 hours. It should be mentioned that the 6%W alloy (Alloy 3) of the invention exhibited remarkable creep resistance.

TABLE II

| Alloy | Cr % | W % | Ni % | Ti % | Al % | B % | C % | Mg % | Fe % | Other | Minimum Creep Rate,%/hr. |
|---|---|---|---|---|---|---|---|---|---|---|---|
| K | 22 | 3 | 54 | 0.35 | 0.05 | 0.004 | 0.02 | 0.016 | Bal. | 9 Mo | 0.00275 |
| G | 22 | 3 | 54 | 0.35 | 1 | 0.003 | 0.01 | 0.009 | Bal. | — | 0.0039 |
| H | 22 | 6 | 54 | 0.35 | 1 | 0.004 | < .01 | 0.008 | Bal. | — | 0.011 |
| 7 | 21.76 | 3.37 | 54.86 | 0.44 | 0.08 | 0.002 | 0.03 | 0.012 | Bal. | 0.1 Cb | 0.000011 |
| 3 | 21.90 | 5.88 | 54.75 | 0.43 | 0.07 | 0.004 | 0.04 | 0.023 | Bal. | — | 0.000005 |

TABLE II-continued

| Alloy | Cr % | W % | Ni % | Ti % | Al % | B % | C % | Mg % | Fe % | Other | Minimum Creep Rate,%/hr. |
|---|---|---|---|---|---|---|---|---|---|---|---|
| 4 | 21.78 | 8.7 | 54.36 | 0.43 | 0.07 | 0.003 | 0.04 | 0.025 | Bal. | — | 0.0000375 |

With regard to affording good microstructural stability after exposure to high temperature, various alloy compositions were subjected to test treatments: treatment "A" involved solution heating at 2250° F./1 hr., followed by water cooling and testing at room temperature; treatment "B" comprised solution heating at 2250° F./1 hr., water quenched plus 1472° F. for 100 hours followed by an air cool and then testing; treatment "C" was the same as "B" except 1832° F. was used rather than 1472° F. The data is reported in Table III.

TABLE III

| Alloy | Cr | W | Ni | Ti | Al | Fe | Heat Treatment | Elong., (%) | RA, (%) | Charpy V, ft. lbs. |
|---|---|---|---|---|---|---|---|---|---|---|
| 7 | 21.76 | 3.37 | 54.86 | 0.44 | 0.08 | Bal. | A | 58 | 77.3 | — |
| | | | | | | | B | 42 | 48.3 | — |
| | | | | | | | C | 51 | 61.6 | 228 |
| 3 | 21.90 | 5.88 | 54.75 | 0.43 | 0.07 | Bal. | A | 59 | 71.8 | — |
| | | | | | | | B | 38 | 45.9 | — |
| | | | | | | | C | 47 | 58.8 | 158 |
| 4 | 21.78 | 8.7 | 54.36 | 0.43 | 0.07 | Bal. | A | 56 | 14.6 | 237 |
| | | | | | | | B | 38 | 39.5 | 130 |
| | | | | | | | C | 47 | 66.9 | 199 |
| L | 22 | 9 | 54 | 0.35 | 0.05 | Bal. | A | | | 238 |
| | | | | | | | B | | | 25 |
| | | | | | | | C | | | 6 |
| I | 22 | 9 | 54 | 0.35 | 1 | Bal. | A | 76 | 70 | 217 |
| | | | | | | | B | 22 | 20.3 | 19.5 |
| | | | | | | | C | 8 | 10 | 4 |
| M | 22 | 9 | 54 | 0.35 | 0.05 | Bal. | A | 67 | 76.7 | 239 |
| | | | | | | | B | 48 | 49.5 | — |
| | | | | | | | C | — | — | 49 |

Alloys L, I & M contain 9%, 9% & 6% Mo, respectively

It will be observed that alloys within the invention manifested good stability upon 100 hour exposure at the temperatures 1472° F. and 1832° F. (treatments "B" and "C") as well as good ductility properties.

Although the invention has been described in connection with preferred embodiments, modifications may be resorted to without departing from the spirit and scope of the invention, as those skilled in the art will readily understand. Such are considered within the purview and scope of the invention and appended claims.

We claim:

1. A nickel-base alloy adapted for use in high temperature gas cooled reactor and having a high resistance to creep at elevated temperatures, the alloy consisting essentially of about 22% to 28% chromium, about 3% to 9% tungsten, titanium in an amount sufficient to enhance the malleability of the alloy and up to about 1%, up to 0.1% carbon, up to about 0.15% aluminum, and the balance essentially nickel, said alloy being substantially free of cobalt for HTGR use.

2. An alloy in accordance with claim 1 in which the chromium is from 23 to 26% and nickel is present in an amount of at least 50%.

3. An alloy in accordance with claim 1 in which the tungsten is about 5 to 7%.

4. An alloy in accordance with claim 1 in which the titanium is about 0.25% to 0.5%.

5. An alloy in accordance with claim 1 in which the carbon does not exceed about 0.06% and which contains 5 to 25% iron.

6. An alloy in accordance with claim 1 containing 23 to 26% chromium, 5 to 7% tungsten, 0.25 to 0.5% titanium, not more than 0.06% carbon, from 8 to 25% iron and from 50 to 65% nickel.

* * * * *